US010898788B2

(12) United States Patent
Bellaire et al.

(10) Patent No.: US 10,898,788 B2
(45) Date of Patent: Jan. 26, 2021

(54) GAME HAVING PERSONALIZED GAME PIECES WITH SELECTIVELY REMOVABLE MAGNETIZED PIECES AND ACCESSORIES

(71) Applicant: The Upper Deck Company, Carlsbad, CA (US)

(72) Inventors: Carmen Bellaire, Ontario (CA); Jason Brenner, San Marcos, CA (US)

(73) Assignee: THE UPPER DECK COMPANY, Carlsbad, CA (US)

( * ) Notice: Subject to any disclaimer, the term of this patent is extended or adjusted under 35 U.S.C. 154(b) by 0 days.

(21) Appl. No.: 15/727,557

(22) Filed: Oct. 6, 2017

(65) Prior Publication Data

US 2018/0099213 A1 Apr. 12, 2018

Related U.S. Application Data

(60) Provisional application No. 62/405,756, filed on Oct. 7, 2016.

(51) Int. Cl.
*A63F 3/00* (2006.01)

(52) U.S. Cl.
CPC ..... *A63F 3/00697* (2013.01); *A63F 3/00075* (2013.01); *A63F 2003/00195* (2013.01); *A63F 2003/00738* (2013.01); *A63F 2003/00826* (2013.01); *A63F 2003/00883* (2013.01)

(58) Field of Classification Search
CPC .... A63F 3/00075; A63F 3/00697; A63F 3/16; A63F 2003/00195; A63F 2003/00738; A63F 2003/00719; A63F 2003/00826
USPC ..... 273/289, 290; 446/99, 321
See application file for complete search history.

(56) References Cited

U.S. PATENT DOCUMENTS 1,211,590 A * 1/1917 Kennedy ..... A63H 3/16 223/68
1,322,713 A * 11/1919 Marshall ..... A63H 3/16 446/100
3,375,604 A * 4/1968 Alonso ..... A63H 3/16 446/92
3,876,207 A * 4/1975 Jones ..... A63F 3/00694 273/141 A
4,038,775 A 8/1977 Sato
4,118,888 A 10/1978 Ogawa
4,161,315 A * 7/1979 Walton ..... A63F 11/00 273/262
4,205,850 A * 6/1980 Craig ..... A63F 9/10 273/157 R
4,634,129 A * 1/1987 Martinez ..... A63F 3/00697 273/146

(Continued)

*Primary Examiner* — Joseph B Baldori
(74) *Attorney, Agent, or Firm* — Roeder & Broder LLP; Steven G. Roeder

(57) ABSTRACT

A board game includes a game metric and a game piece. The game piece is usable within the game metric. The game piece includes a game piece body, and a plurality of interchangeable components that are selectively and magnetically coupled to the game piece body. The game can further include a first magnet that is coupled to the game piece body, and a second magnet that is coupled to one of the plurality of interchangeable components. The magnets can be positioned relative to one another such that the first magnet selectively engages the second magnet so that the one of the plurality of interchangeable components can be selectively and magnetically coupled to the game piece body.

18 Claims, 11 Drawing Sheets

(56) References Cited

U.S. PATENT DOCUMENTS

| | | | | |
|---|---|---|---|---|
| 4,950,912 | A * | 8/1990 | Goldfarb | A63F 3/00006 273/249 |
| 5,295,889 | A | 3/1994 | Ejima | |
| 5,766,077 | A | 6/1998 | Hongo | |
| 6,893,315 | B2 * | 5/2005 | Barri | A63H 3/46 446/376 |
| 6,964,417 | B2 | 11/2005 | Bodish | |
| 7,077,400 | B2 * | 7/2006 | Kenney | A63F 3/00697 273/242 |
| 7,111,844 | B2 | 9/2006 | Andrie et al. | |
| 7,201,374 | B2 | 4/2007 | Bielman | |
| 7,291,052 | B2 * | 11/2007 | Ellman | A63H 3/16 446/100 |
| 7,520,793 | B2 | 4/2009 | Pillai et al. | |
| 7,575,496 | B2 | 8/2009 | Lau et al. | |
| 2003/0020239 | A1 | 1/2003 | Hagen et al. | |
| 2004/0051245 | A1 | 3/2004 | Weisman et al. | |
| 2004/0212148 | A1 | 10/2004 | Losey et al. | |
| 2007/0060011 | A1 | 3/2007 | Daftari et al. | |
| 2007/0187894 | A1 | 8/2007 | Walterscheid | |
| 2008/0023913 | A1 | 1/2008 | Barthold et al. | |
| 2013/0313775 | A1 | 11/2013 | Foss | |
| 2014/0062018 | A1 * | 3/2014 | Priebe | A63F 3/00028 273/236 |
| 2014/0084542 | A1 | 3/2014 | Ziran et al. | |

* cited by examiner

GAME HAVING PERSONALIZED GAME PIECES WITH SELECTIVELY REMOVABLE MAGNETIZED PIECES AND ACCESSORIES

RELATED APPLICATION

This application claims priority on U.S. Provisional Application Ser. No. 62/405,756, filed Oct. 7, 2016 and entitled "GAME HAVING PERSONALIZED GAME PIECES WITH SELECTIVELY REMOVABLE MAGNETIZED PIECES AND ACCESSORIES". As far as permitted, the contents of U.S. Provisional Application Ser. No. 62/405,756 are incorporated herein by reference.

BACKGROUND

Many people, especially children, enjoy playing board games that involve battles that are waged between personalized game pieces. Such personalized game pieces typically have certain associated strengths, weaknesses, features, and characteristics that can be varied in order to more effectively wage such battles.

SUMMARY

The present invention is directed toward a board game including a game mechanic and a game piece. The game piece is usable within the game mechanic. In various embodiments, the game piece includes a game piece body, and a plurality of interchangeable components that are selectively and magnetically coupled to the game piece body. Alternatively, in other embodiments, the plurality of interchangeable components can be selectively coupled to the game piece body in another suitable manner.

In certain embodiments, the board game can be a battle-based board game. Alternatively, the board game can be in other than a battle-game type format. Additionally, it should be understood that the board game can be in the form of a physical board game and/or the board game can be in the form of a digital board game.

It should be appreciated that the game piece can be provided in any suitable and/or desired form. For example, in different embodiments, the game piece can be provided in humanoid form, animal form, insect form, arachnid form (e.g., spider-like bots), creature form, robot form, or any other desired form. Additionally, the game piece can also be transformed from one type to another during play of the game. As such, the interchangeable components can include any types and varieties of appendages and attachments that are appropriate to form the desired form for the game piece.

In some embodiments, the game further includes a first magnet that is coupled to the game piece body, and a second magnet that is coupled to one of the plurality of interchangeable components. In such embodiments, the magnets can be positioned relative to one another such that the first magnet selectively engages the second magnet so that the one of the plurality of interchangeable components can be selectively and magnetically coupled to the game piece body.

Further, in certain embodiments, the game piece body includes a torso, and the plurality of interchangeable components includes a plurality of heads. Additionally and/or alternatively, the plurality of interchangeable components can include a plurality of arms. Still alternatively, the plurality of interchangeable components can include a plurality of legs. Yet alternatively, the plurality of interchangeable components includes a plurality of weapons. Still yet alternatively, the plurality of interchangeable components can include a plurality of defense mechanisms.

Additionally, the present invention is further directed toward a method for providing a board game, the method including the steps of (i) providing a game mechanic; and (ii) utilizing a game piece within the game mechanic, the game piece including a game piece body, and a plurality of interchangeable components that are selectively and magnetically coupled to the game piece body.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION

Embodiments of the present invention are described herein in the context of a board game, e.g., a physical board game and/or a digital board game, including a plurality of game pieces each having a game piece body and one or more interchangeable parts and/or accessories that are selectively coupled, e.g., magnetically coupled, to the game piece body. In various embodiments, the board game is referred to as "Deus Machina". Therefore, the term "board game" is utilized somewhat interchangeably herein with the game name "Deus Machina". It should be understood, however, that the board game can be played with any suitable name, and the use of the name "Deus Machina" is not intended to be limiting in any manner. Additionally, in certain alternative embodiments, the one or more interchangeable parts and/or accessories can be selectively coupled to the game piece body in another suitable manner, i.e. other than magnetically. For example, in one non-exclusive alternative embodiment, the one or more interchangeable parts and/or accessories can be selectively coupled to the game piece body with some type of adhesive material.

Those of ordinary skill in the art will realize that the following detailed description of the present invention is illustrative only and is not intended to be in any way limiting. Other embodiments of the present invention will readily suggest themselves to such skilled persons having the benefit of this disclosure. Reference will now be made in detail to implementations of the present invention as illustrated in the accompanying drawings. The same or similar nomenclature and/or reference indicators will be used throughout the drawings and the following detailed description to refer to the same or like parts.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application-related and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

The board game, as illustrated and described in detail herein, is a battle-type board game that is intended to be played by a plurality of players. For example, in certain non-exclusive embodiments, the board game is intended to be played by anywhere from two to six players. Alternatively, in some embodiments, the board game can be designed to be played in other than a battle-type format.

Figure 10:
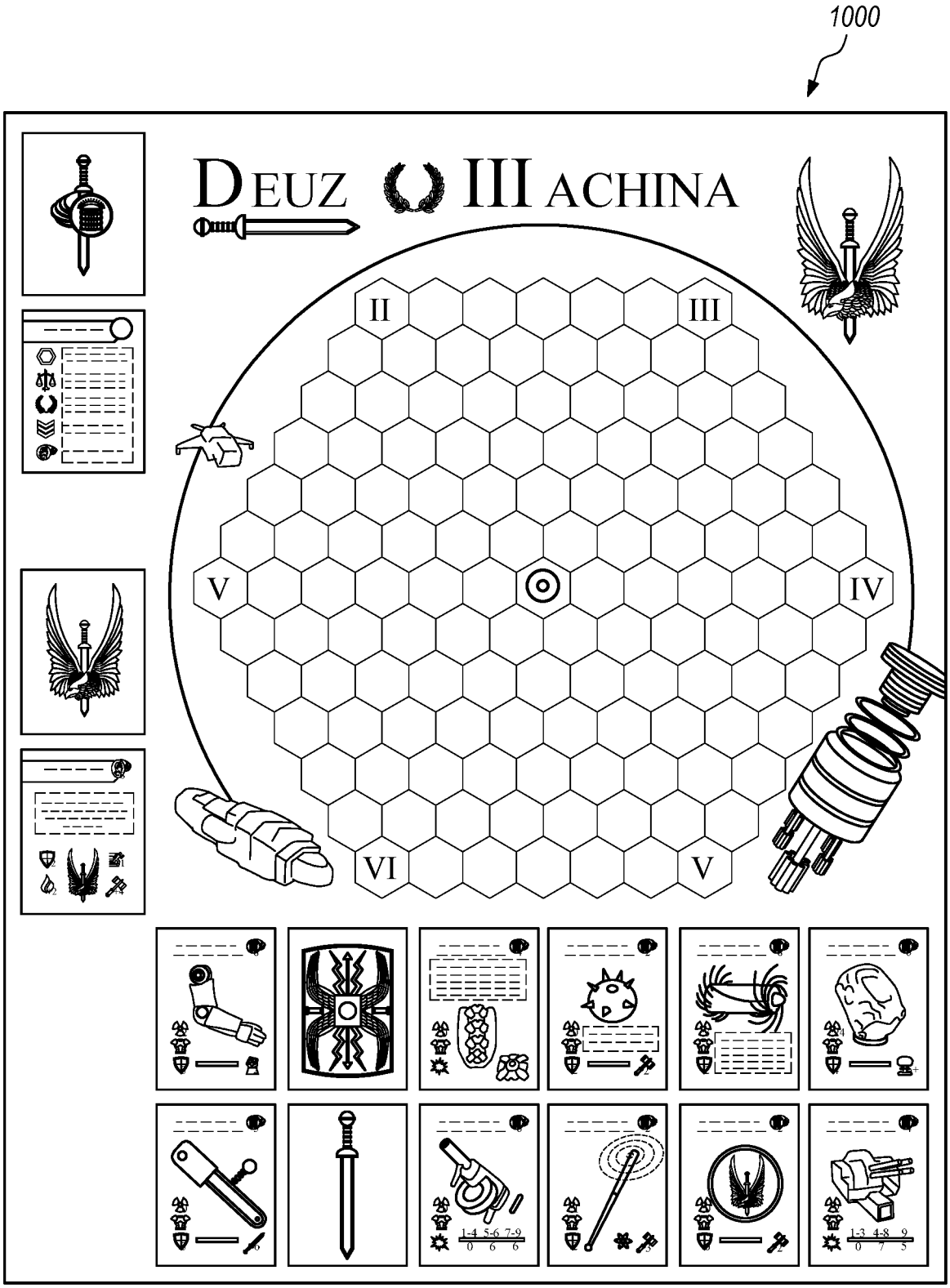
FIG. 10 is an illustration showing an exemplary embodiment of a layout of a game board utilized in the game play of the board game.
Figure 11A:
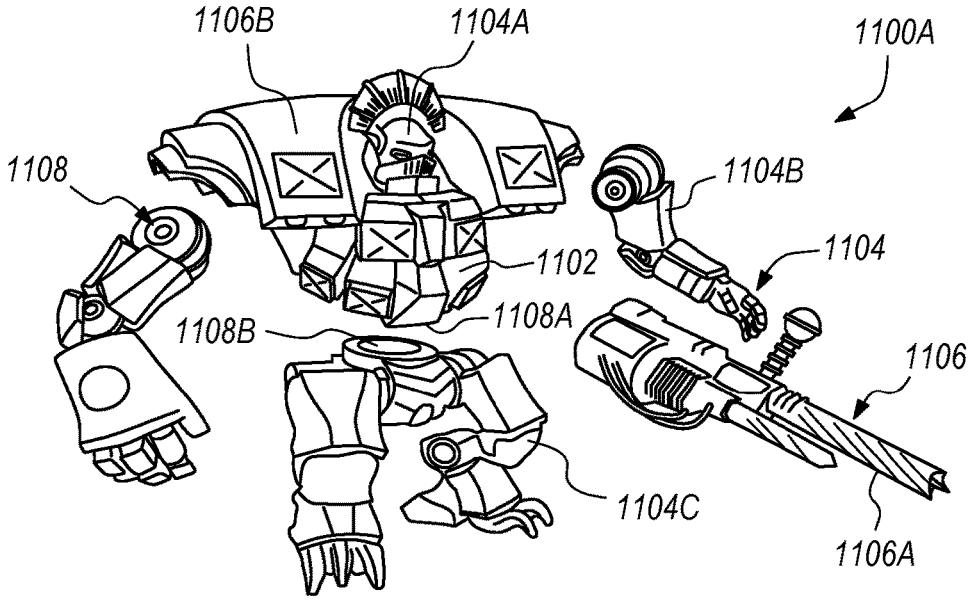
FIG. 11A is a partially exploded front perspective view of an exemplary embodiment of a game piece utilized in the game play of the board game.
Figure 11B:
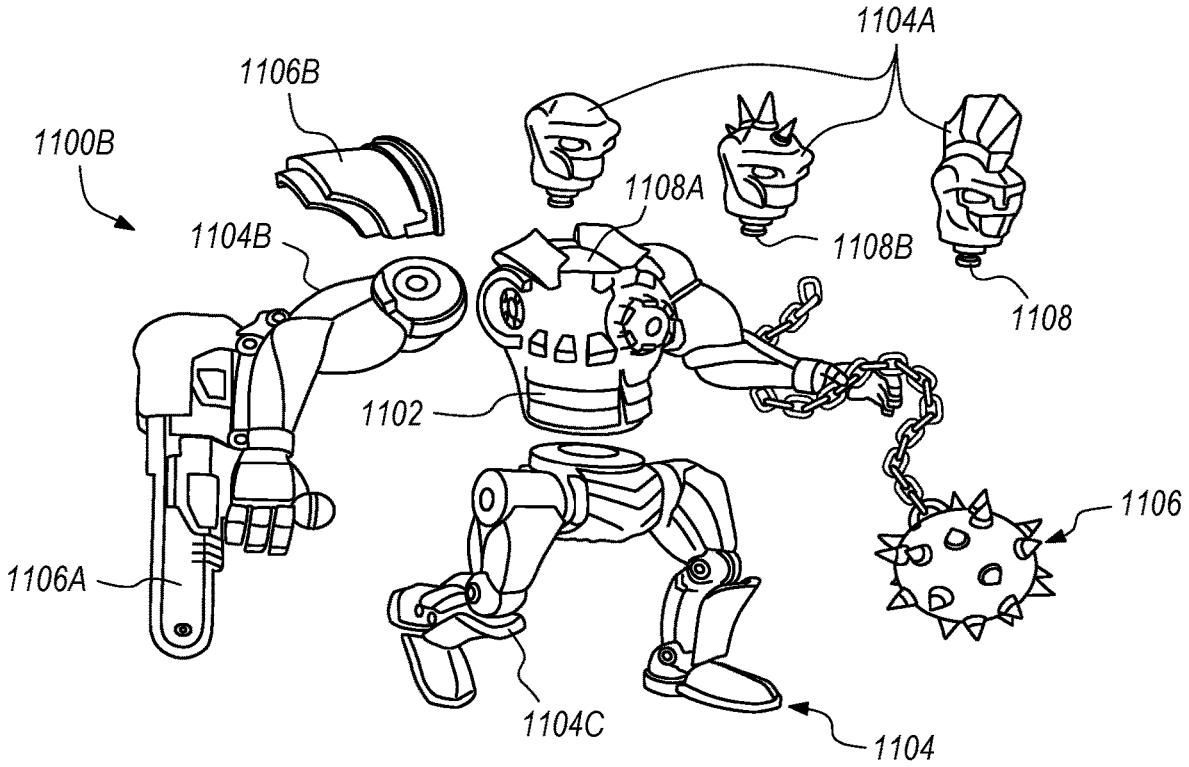
FIG. 11B is a partially exploded front perspective view of another exemplary embodiment of a game piece utilized in the game play of the board game.

In various embodiments, the board game includes a game board 1000 (illustrated in FIG. 10), a plurality of game cards, a plurality of game dice, a plurality of game pieces 1100A, 1100B (examples of which are illustrated in FIG. 11A and FIG. 11B, and with one or more such game pieces 1100A, 1100B being utilized by each of the players in the board game), and a game mechanic (i.e. a set of game rules by which the board game is to be played). Alternatively, the board game can be configured to use more elements or fewer elements than those specifically described herein.

As an overview, in certain embodiments, the board game is designed to utilize game pieces 1100A, 1100B that are uniquely designed, with each game piece 1100A, 1100B including a game piece body 1102 (e.g., a torso, illustrated in FIG. 11A and FIG. 11B), and one or more interchangeable parts 1104 (illustrated in FIG. 11A and FIG. 11B), e.g., arms, legs, head, etc., and/or one or more interchangeable accessories 1106 (illustrated in FIG. 11A and FIG. 11B) that can be selectively coupled to the game piece body 1102. More specifically, the game piece body 1102 and the interchangeable parts 1104 and/or the interchangeable accessories 1106 can each include magnetic material that enable the interchangeable parts 1104 and/or the interchangeable accessories 1106 to be selectively, magnetically coupled to the game piece body 1102 in particular locations on the game piece body 1102. Certain examples of such features will be described in greater detail herein below. As utilized herein, the interchangeable parts 1104 and/or the interchangeable accessories 1106 can be referred to herein generally as "components".

Additionally, at certain points during play of the board game, it may be desired or necessary for one or more players to interchange one or more parts 1104 or accessories 1106 that are being used with their game piece 1100A, 1100B. Thus, the ability of the game piece 1100A, 1100B and the game piece body 1102 to uniquely include one or more parts 1104 and/or accessories 1106 that are selectively and interchangeably coupled, e.g. magnetically, to the game piece body 1102 can greatly enhance the play of the board game. For example, in certain applications, any battles that are waged between competing game pieces 1100A, 1100B during play of the board game can result in one or both of the game pieces 1100A, 1100B losing one or more parts 1104, e.g., arms or legs, and/or accessories 1106, e.g., weapons or defense mechanisms, based on the outcome of the battle. In such applications it may be available for the players to replace the lost parts 1104 and/or accessories 1106 with one or more of the otherwise available interchangeable parts 1104 and accessories 1106. In other applications, the players may obtain certain cards during play of the game that enable that player to upgrade to different interchangeable parts 1104 or accessories 1106 with their game piece 1100A, 1100B that provide the player with enhanced play of game features. It is appreciated that still other applications may exist during play of the game as for how and why a player may be required to or otherwise desire to interchange one or more parts 1104 or accessories 1106 that are being used with their game piece 1100A, 1100B.

As provided herein, the game pieces 1100A, 1100B, and thus the various components, parts 1104 and/or accessories 1106 that are magnetically coupled to the game piece body 1102 to make up the game pieces 1100A, 1100B, can come in any suitable or desired form. For example, in certain non-exclusive alternative embodiments, the game pieces 1100A, 1100B can come in substantially humanoid form, animal form, insect form, arachnid form (e.g., spider-like bots), creature form, robot form, or any other desired form.

Additionally, as noted above, the game mechanic sets forth the rules by which the board game, e.g., Deus Machina, is to be played. Such game mechanic, as well as the various elements used within the board game, are set forth herein. It should be appreciated, however, that certain portions of the game mechanic, as described, can be altered or eliminated, and/or additional rules can be added, without deviating from the intended scope and breadth of the present invention.

In various embodiments, in a game of Deus Machina, each of the players can take on the role of a gladiator. The gladiator, however, may not be just any gladiator, but can be described as the Dominus and head of your Ludus. During play of the board game, the gladiators of Deus Machina do not fight one another face-to-face on the sands of the arena. Instead, the gladiators can be utilized to pilot massive, one thousand (1,000) foot tall robots called the "Deus Machina" (god machines) in honor of the gods whose glory they fight for. Indeed, the Deus Machina are so large that they must do battle on a specially prepared rogue moon (i.e. the game board 1000), so that the force of gravity does not slow down their actions too badly.

During play of the board game, the players will have an opportunity to purchase new and better weapons and components with which to build their Deus Machina. As provided herein, such weapons and components can be freely interchangeable on the body of the Deus Machina, with the selective coupling of the weapons and components be accomplished through use of one or more magnets 1108 (illustrated, for example, in FIG. 11A) on the weapons and components and/or on the body of the Deus Machina. Then, the Deus Machina of each player will be sent into the arena to be pitted against the other gladiators to see who will survive, grow in experience and amass the wealth that is needed to keep the Deus Machina ready for battle. The ultimate winner of a game of Deus Machina is the player that manages to become the Champion of the final match of the season, the Primus.

Figure 1A:
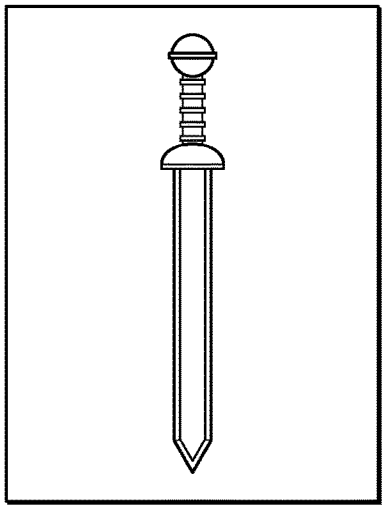
FIGS. 1A-1G are illustrations showing embodiments of card backs of various types of cards utilized in game play of a board game.
Figure 1B:
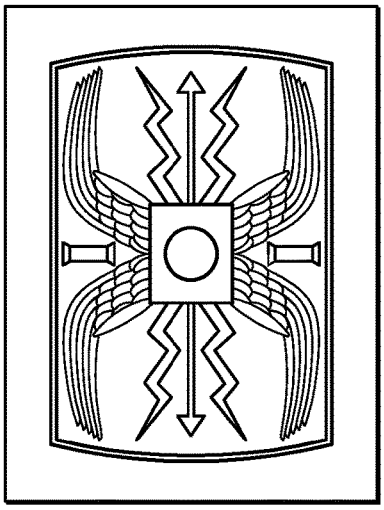
Figure 1C:
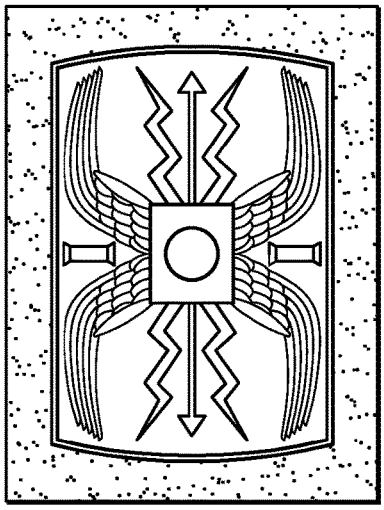

The Card Decks:

Component Cards: There are two types of Component Decks used in the game. The first deck includes Weapon Components Cards marked by the Gladius on the card backs (see FIG. 1A), while the other deck includes Non-Weapon Components Cards marked with the Scutum shield pattern on the card backs (see FIG. 1B). A third type of Component card is the basic Tiro components that all players will start play with and will have in their Component piles for the duration of the game. These Tiro components are marked with the same Scutum shield pattern as on the Non-Weapon Component cards, but on a pure black background (see FIG. 1C).

Figure 1D:
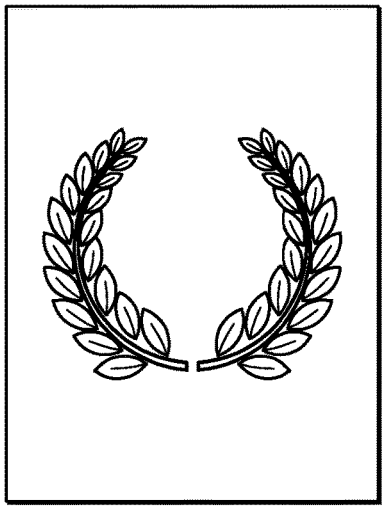

Gladiator Cards: The next important deck of cards is the Gladiators, marked with a wreath on the back of the cards (see FIG. 1D). Each player will have to pick a Gladiator to play during the game. The Gladiator Cards deck is made up of six Gladiator cards that represent the Gladiator and all his or her potential improvements in rank. Note that all the unused Gladiators will be set aside during game play and will only be taken out again if one of the Gladiators dies during game play.

Figure 1E:
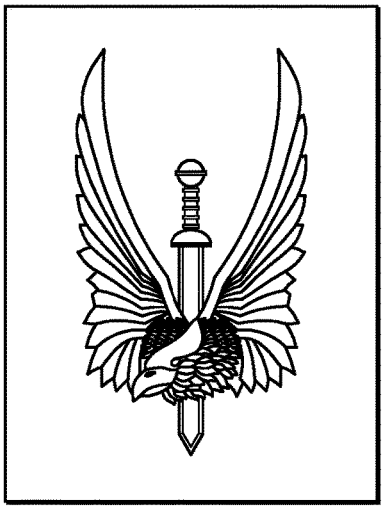

Tribute Cards: Tribute Cards can be identified by the Aquila on the back of the cards (see FIG. 1E). Tribute cards can be used for a variety of purposes during the game. They can be cashed in for their gold value, they can be used to boost a Deus Machina's Speed or Defensive Dice, or they can be used to boost the Attack Dice of a ranged or melee weapon. Finally, a Tribute card may be used to play its Tribute Action, but regardless of how the card is played it is discarded, meaning that only one of its six possible uses can be used.

Figure 1F:
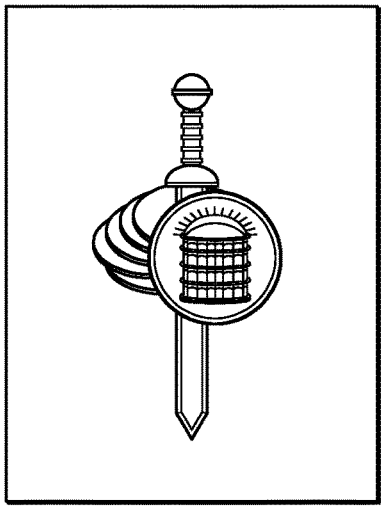

Arena Cards: The final deck of cards that you will need to know is the Arena cards, denoted by the sword and coin icon (see FIG. 1F). The Arena cards are used to time the game and tell you how each match in the arena will be fought. When the "Primus" Arena card is drawn, you know you are playing the last match of the game.

Figure 1G:
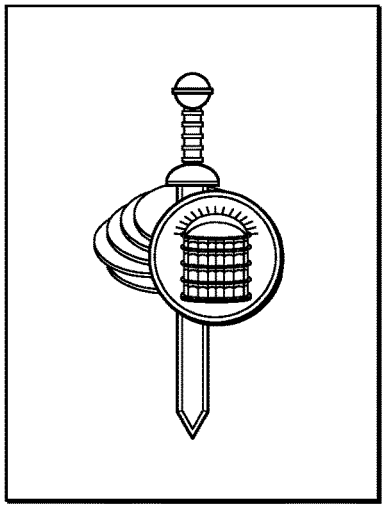

Betting Cards: There is also another card with the same icon on the back, but on a black background, that each player will be given at the beginning of the game and that is the Betting card (see FIG. 1G), which is used to place bets on the outcome of each match in the arena.

Figure 2:
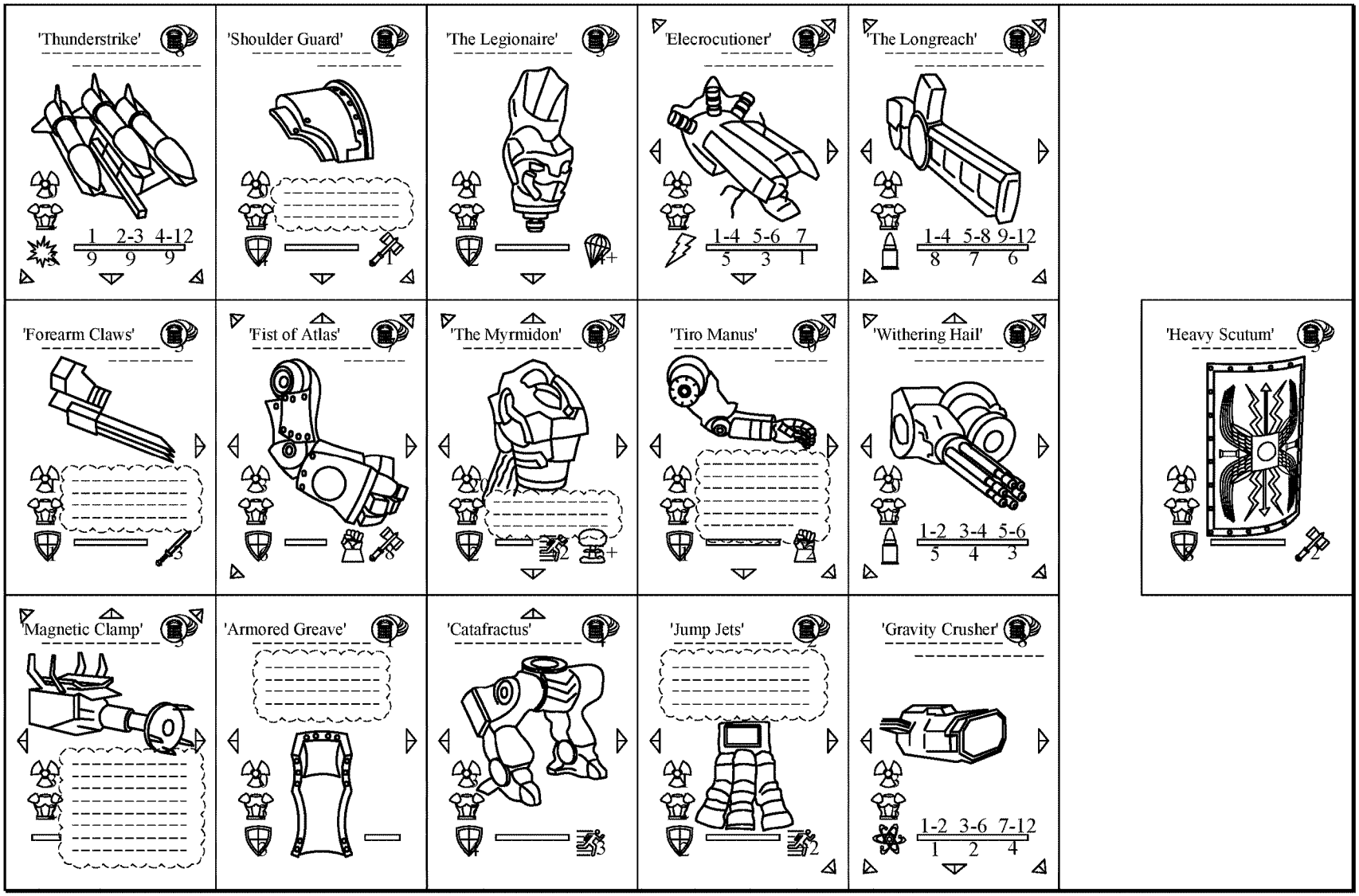
FIG. 2 is an illustration showing an exemplary embodiment of a layout of Component Cards that can be utilized in the building of a game piece for use in the game play of the board game.

A Sample Deus Machina Layout: FIG. 2 is an exemplary embodiment of a layout of Component Cards that can be utilized in the building of a game piece, i.e. a Deus Machina, for use in the game play of the board game. In certain embodiments, there can be no more than three rows and five columns of Components that are used to build the Deus Machina. Additionally, as shown, it should be noted that Hand Held Weapons are not part of any row or column.

There are 3 basic rules to remember when laying out a Deus Machina:

1. First, each Component must connect to at least one other Component by the small golden arrows printed on each card. Each Component may connect by more than one arrow, or it may have some arrows that do not connect to anything, but it is still a legal build if each of the Components are connected to at least one other component on the Deus Machina in a chain of connection points leading all the way back to the torso at the center.

2. Next, the power cost of all Components must be equal to or less than the power produced by the torso and power generators of the Deus Machina combined.

3. Finally, the Deus Machina cannot have more than three rows and five columns as shown above, with the standard humanoid pattern (head/cockpit, torso, two arms and a pair of legs) at the center of the build. Likewise, the Deus Machina can only hold one Hand Held Weapon per "hand", as shown on its cards. Hand Held Weapons are never directly connected to another Component.

Figure 3A:
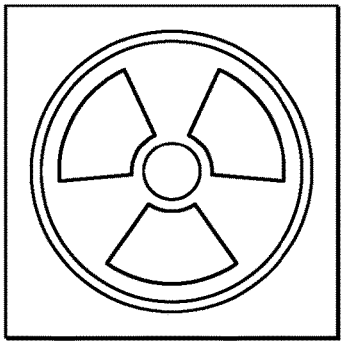
FIGS. 3A-3H are illustrations showing embodiments of Component Card symbols that can be utilized in determining the proper game play for each of the Component Cards in the board game.
Figure 3B:
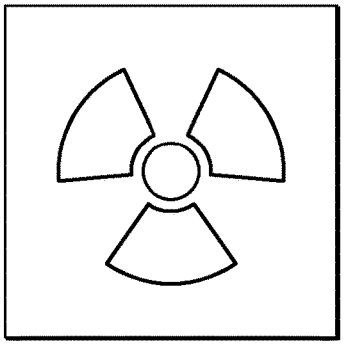

Component Card Symbols:

In various embodiments, either a Power Production symbol (see FIG. 3A) or a Power Cost symbol (see FIG. 3B) will be on the appropriate Component Card for each Component.

Figure 3C:
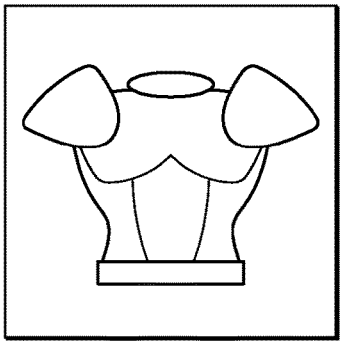

An Armor symbol (see FIG. 3C) will also be on the Component Card for each Component. The Armor symbol denotes and/or measures how many successful hits are required to damage the Component, with the understanding that fewer hits will do nothing at all to the Component.

Figure 3D:
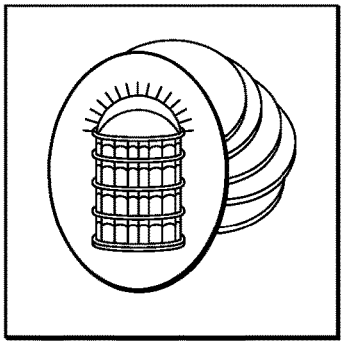

A Cost symbol (see FIG. 3D) for each Component is listed in the top corner of the Component card. It is important to remember that the bank will buy back an undamaged Component at any time during game play. Doing so returns the Component in question to the appropriate discard pile.

Figure 3E:
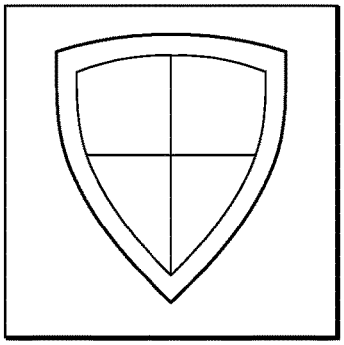

A Defense symbol (see FIG. 3E) is used to determine the number of Defense dice the Deus Machina has when countering both melee and ranged attacks made against it, as described in greater detail herein below.

Figure 3F:
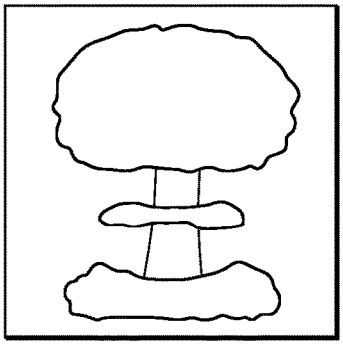

A Meltdown symbol (see FIG. 3F) is only found on Components with the Power Production symbol. When such a power Component is damaged, a single D6 is rolled during the Resolution Step of the Combat Step to see if the Deus Machina melts down. On the roll indicated (4+, 6+, etc.), the Deus Machina melts down and does a D6 hits (only roll once for all) to each of its Components and to all the Components of all the Deus Machina in all six hexes adjacent to it on the game board.

Figure 3G:
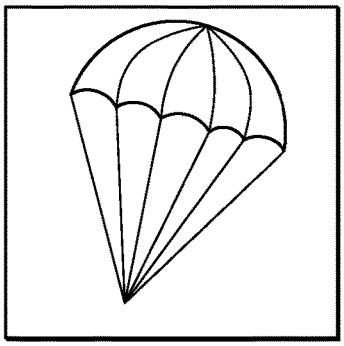

An Ejection symbol (see FIG. 3G) is only found on the cockpit of a Deus Machina. If the cockpit is damaged, by rolling a D6, on the indicated roll (4+, 6+, etc.), the Gladiator can be ejected from the Deus Machina safely. However, if the roll fails (i.e. if a D6 is not successfully rolled), the Gladiator must make an Endurance check or die. In either instance, the Gladiator is out of that match.

Figure 3H:
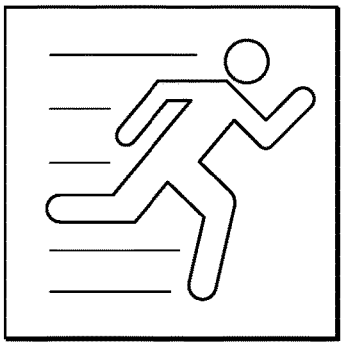

A Speed symbol (see FIG. 3H) is found on each set of legs and represents the basic speed of the Deus Machina, i.e. how many spaces or hexes of movement the Deus Machina can make during a single movement. Additionally, the jump jets and some of the torsos optimized for speed, will have a Speed bonus (+2, +3, etc.), which is added to the base Speed provided by the legs of the Deus Machina.

Figure 4A:
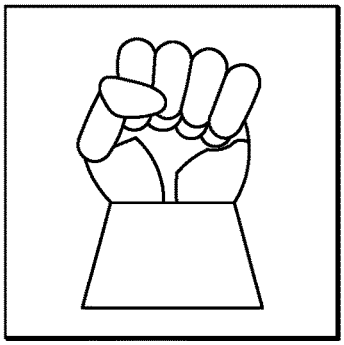
FIGS. 4A-4C are illustrations showing embodiments of Melee Combat symbols that can be utilized in determining the proper game play in the board game.
Figure 4B:
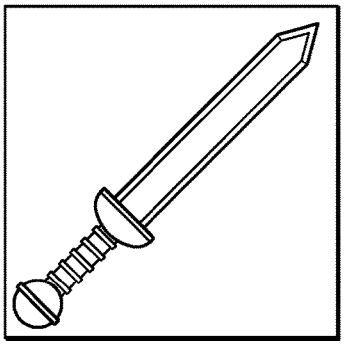
Figure 4C:
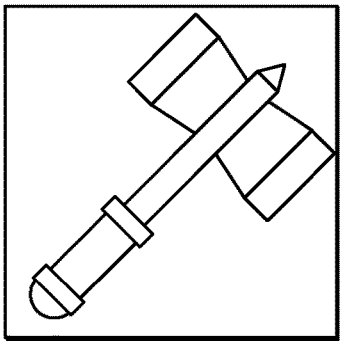

Melee Combat Symbols:

In Melee Combat, there are 3 attack symbols. These attack symbols are a Basic Attack (or hand) symbol (see FIG. 4A), a Cutting Attack symbol (see FIG. 4B), and an Impact Attack symbol (see FIG. 4C). The melee attack symbol will also be accompanied by a number, which is the number of Attack dice gained for that particular weapon.

Figure 5A:
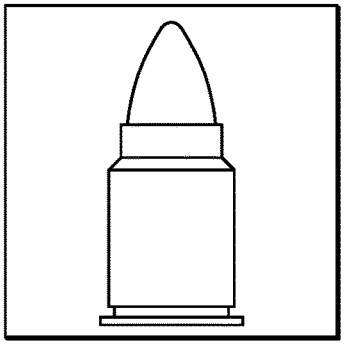
FIGS. 5A-5G are illustrations showing embodiments of Range Combat symbols that can be utilized in determining the proper game play in the board game.
Figure 5B:
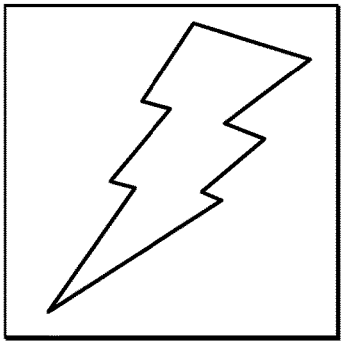
Figure 5C:
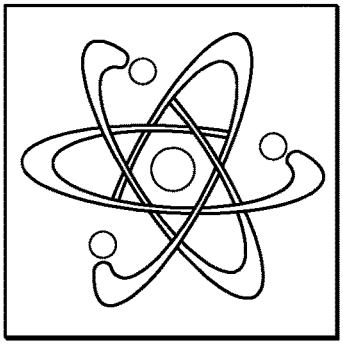
Figure 5D:
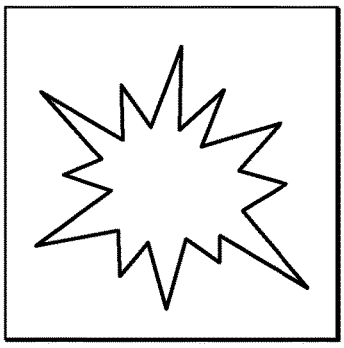
Figure 5E:
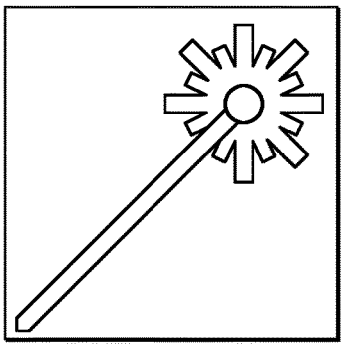
Figure 5F:
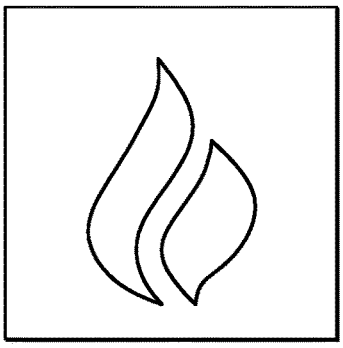

Ranged Combat Symbols:

While in Ranged Combat, there are 6 different attack symbols for the various categories of damage that can be inflicted. In particular, such attack symbols include a Ballistic Attack symbol (see FIG. 5A), an Electricity Attack symbol (see FIG. 5B), an Energy Attack symbol (see FIG. 5C), an Explosive Attack symbol (see FIG. 5D), a Laser Attack symbol (see FIG. 5E), and a Thermal Attack symbol (see FIG. 5F).

Figure 5G:
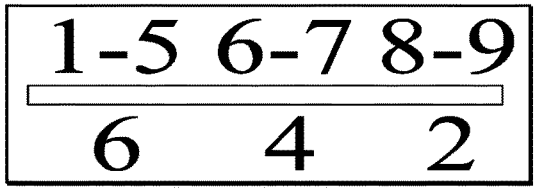

In addition to their attack symbol, ranged weapons will have a Range Attack Bar (see FIG. 5G) which shows the range in hexes and number of Attack dice at a given range. Green is short range (shown is 1-5 hexes, with six Attack dice), yellow is medium range (6-7 hexes, and four Attack dice) and red is long range (8-9 hexes, with only two Attack dice).

Explosive weapons are special in that they can shoot over other Deus Machina and wall sections, but they also have limited ammunition as represented by the number over their explosive symbols (use the ammo tokens provided). Once an explosive weapon is out of ammo it cannot fire again during that specific match, but will begin with a fresh ammo supply at the beginning of the next arena match.

Figure 6A:
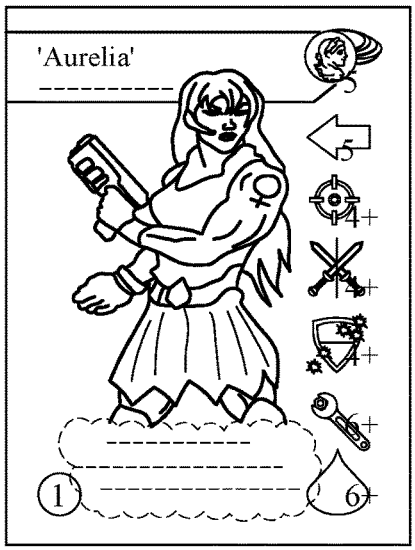
FIGS. 6A-6I are illustrations showing embodiments of Gladiator symbols that can be utilized in determining the proper game play in the board game.

Gladiator Card Symbols:

A chosen Gladiator, an example of which is illustrated in FIG. 6A, represents that player in a game of Deus Machina. The skills and attributes of the Gladiator work hand-in-hand with the Deus Machina that the Gladiator and the player build. A Gladiator has seven abilities: Income, Initiative, Gunnery, Fighting, Defense, Mechanics and Endurance, as well as from one to three Special Skills based on his rank. A Gladiator can have a rank as low as 1, or as high as 6 depending on his success in the arena.

Figure 6B:
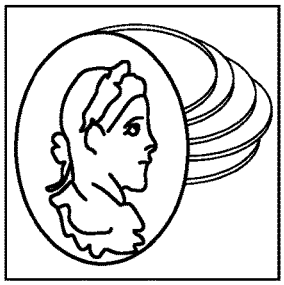

An Income symbol (see FIG. 6B) denotes the amount of gold that the Gladiator gains during the Tribute Step of each turn and is the only guaranteed income the Gladiator will receive during the turn.

Figure 6C:
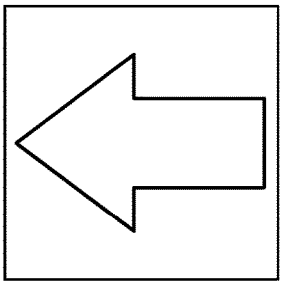

An Initiative symbol (see FIG. 6C) denotes the Initiative that is added to the Gladiator's initiative roll when determining the Initiative Order for the Combat Step. Since it is always an advantage to go last in the Initiative Order, the higher the Initiative the better, but the Champion gains a +3 bonus.

Figure 6D:
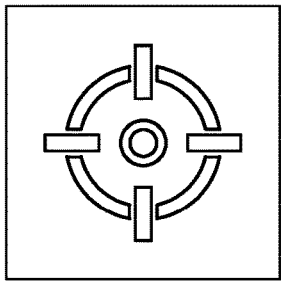

A Gunnery symbol (see FIG. 6D) denotes the Gladiator's ability at hitting during Ranged Combat. Since Gunnery represents a Gladiator's chances of a hit, with 6+ meaning that you only hit on the roll of a 6, and 2+ meaning that you hit on a roll of a 2, 3, 4, 5 or 6, the lower the Gunnery the better. Additionally, it should be remembered that a roll of 1 on the Attack die always misses.

Figure 6E:
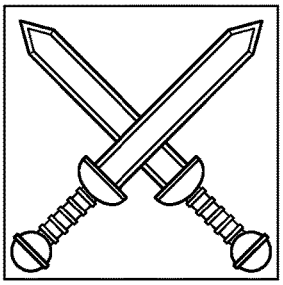

A Fighting symbol (see FIG. 6E) denotes the Gladiator's ability at hitting during Melee Combat. It works in the same fashion as the Gunnery, so the lower the Fighting number the better, and rolls of 1 still always miss.

Figure 6F:
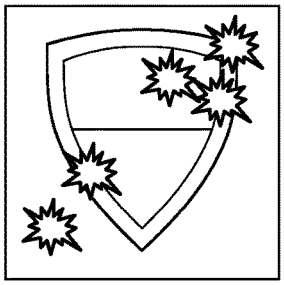

A Defense symbol (see FIG. 6F) functions as the flip side of Gunnery and Fighting. More particularly, Defense works in the same general manner, but is rolled by the defender during an attack. As with Gunnery and Fighting, a roll of 1 always misses.

Figure 6G:
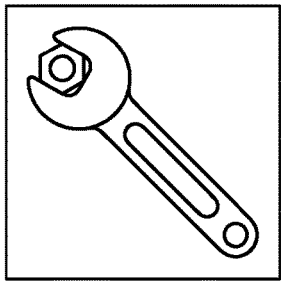

A Mechanics symbol (see FIG. 6G) can be associated with a variety of uses in Deus Machina. For example, the Mechanics symbol can be associated with everything from repairing your Components, to disarming mines, and firing sentry towers is rolled against your Mechanics ability. Just like the other attributes, the lower the score, the better.

Figure 6H:
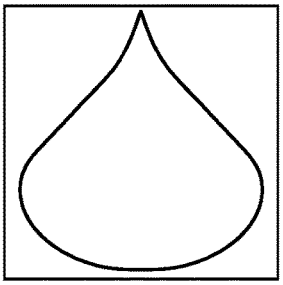

An Endurance symbol (see FIG. 6H) is associated with the Endurance attribute that can be rolled against anytime the Gladiator may die. On a successful roll, the Gladiator is fine, otherwise he dies immediately. It is an all or nothing roll, as the Gladiator is either alive or not. Again, the lower the attribute number, the better.

Figure 6I:
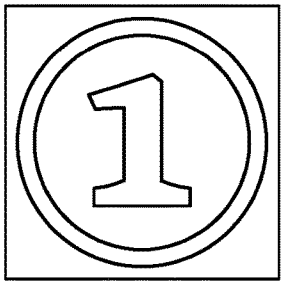

Rank (see FIG. 6I) is measured from 1 to 6, the higher the better. The Rank of a player corresponds to the Gladiator card being used at that moment.

Figure 7A:
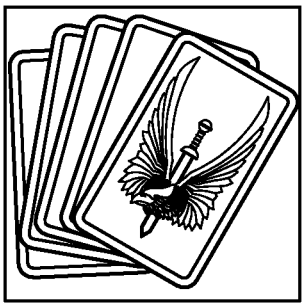
FIGS. 7A-7F are illustrations showing embodiments of Arena Card symbols that can be utilized in determining the proper game play in the board game.

Arena Card Symbols:

A Number symbol (see FIG. 7A) determines the number (from one to five) of Tribute cards dealt out to each player during the Tribute Step of the current turn based on a match to be fought.

Figure 7B:
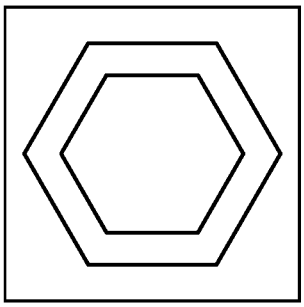

A Deployment symbol (see FIG. 7B) is used to determine how the match is to be fought. Standard solo deployment indicates that all of the players are fighting for themselves, with no allies during the match. Conversely, team deployment creates two specific teams. To form teams for team deployment, the Champion picks a challenger and the first member of his own team. The challenger then picks a player for his team. This continues until all players have been picked. When deploying, the players will place their Deus Machina on one of the six numbered starting hexes according to the Initiative Order, lowest to highest. Note that some match rules will alter this deployment.

Figure 7C:
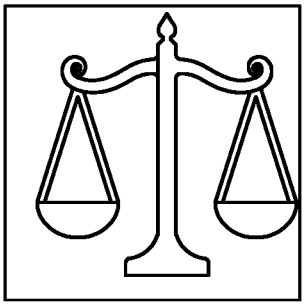
Figure 15:
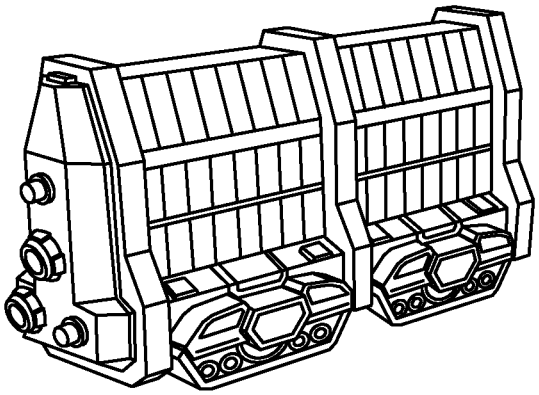
FIG. 15 is an illustration showing an embodiment of a wall section that may be utilized by a player during game play of the board game.

A Balance symbol (see FIG. 7C) denotes that there are a few balancing factors for each match to prevent every fight from being just a slugfest in an open field. The rules of each match will detail any unique balance factors, but the most commonly used is standard wall sections (see FIG. 15). Standard wall sections simply mean that each player may deploy one wall section in addition to his Deus Machina. Note that a player cannot use his or her wall section to completely block in or trap another Deus Machina.

Figure 7D:
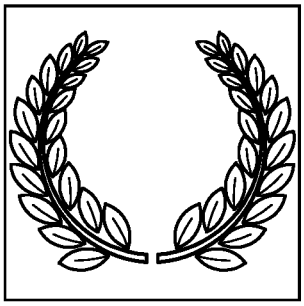

A Champion symbol (see FIG. 7D) is used both to determine the winner and Champion of the match, as well as how the match will end. While several of the matches have unique ending conditions, the two most common are "first kill" and "first blood", which are both purely figurative names, of course. The "first kill" is the easier to explain, as it simply means that the first Gladiator to destroy an opponent's torso or cockpit wins the match. On the other hand, "first blood" means doing significant damage to a Deus Machina. Significant is defined as damaging a number of Components equal to that Gladiator's rank. For example, a Gladiator must damage five Components on a Rank 5 Gladiator's Deus Machina for it to count as a first blood.

Figure 7E:
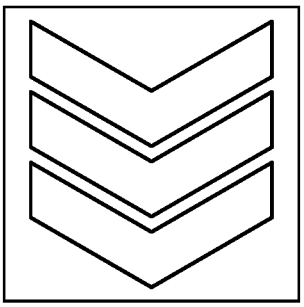

A Promotion symbol (see FIG. 7E) designates who gains a Rank after the match is over. It is important to note that it is not always the winners alone who gain a Rank after the match ends.

Figure 7F:
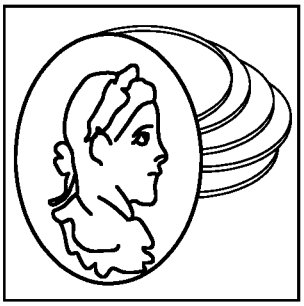

A Prize symbol (see FIG. 7F) designates which Gladiators gain prize gold when the match ends. Like promotions, a Gladiator does not necessarily need to win to gain gold for the match, and many matches have higher prize amounts for the Champion.

Figure 8A:
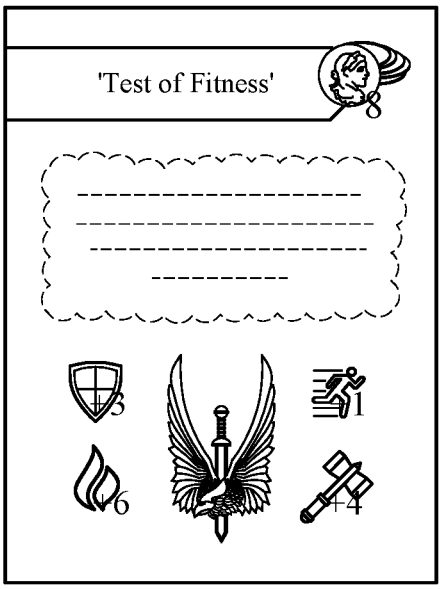
FIGS. 8A and 8B are illustrations showing embodiments of Tribute Card symbols that can be utilized in determining the proper game play in the board game.

Tribute Card Symbols:

The Tribute cards, an example of which is illustrated in FIG. 8A, use many of the same symbols as the Component cards they boost; i.e. Defense, Speed, Range Attack and Melee Attack symbols. See above for the necessary and appropriate symbols relevant to such attributes. Boosting a Component works by simply adding the indicated number (+2, +3, etc.) to the number of Attack dice (melee or ranged), Defense dice or the Speed of the Component in question. Only a single Tribute card can be used in boosting a Component, and the boost only lasts for a single attack roll, defense roll or a single Movement Step. In the case of an attack boost, the symbol must match exactly, and there are times when a ranged boost can be used with a melee weapon (with that symbol on it) and vice versa.

Figure 8B:
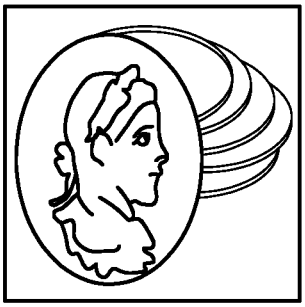

The gold value symbol (see FIG. 8B) indicates how much gold the Tribute card is worth if it is cashed into the bank. A player may cash in a Tribute card at any time for its gold value, but players cannot sell or trade Tribute cards to other players for any reason.

Figure 9A:
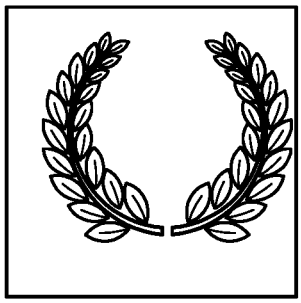
FIGS. 9A-9C are illustrations showing embodiments of Betting Card symbols that can be utilized in determining the proper game play in the board game.
Figure 9B:
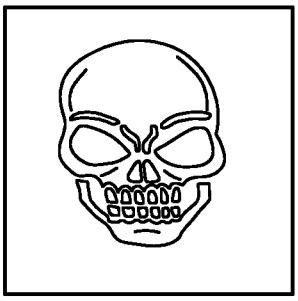
Figure 9C:
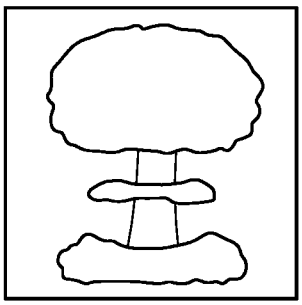

Betting Card Symbols:

There are only three symbols on the betting card. In particular, the different Betting Card symbols include a Win symbol for a given player/Gladiator (see FIG. 9A), a Death symbol for any Gladiator (see FIG. 9B), and a Meltdown symbol for any Gladiator (see FIG. 9C). In some embodiments, a maximum of three gold can be placed on any one bet. However, all three bets can also be placed at one time if desired, for a total of nine gold used in betting. A winning bet pays out at 2-to-1 odds, so if a player bets 3 gold coins, such player will get paid out six gold coins if they win the bet.

Game Board Layout & Setup:

FIG. 10 is an illustration showing an exemplary embodiment of a layout of a game board 1000 utilized in the game play of the board game. As shown, along the game board 1000 can be included the current Arena card. Additionally, the discard piles for the Tribute cards and both the Non-Weapon Component cards and Weapon Component cards are laid out along a corner of the game board 1000. Further, two Component Displays of four Components each are also illustrated along one edge of the game board 1000. Also note, as shown in FIG. 10, that the game board 1000 includes the six numbered starting hexes (labeled I-VI) that were noted above.

Figure 14:
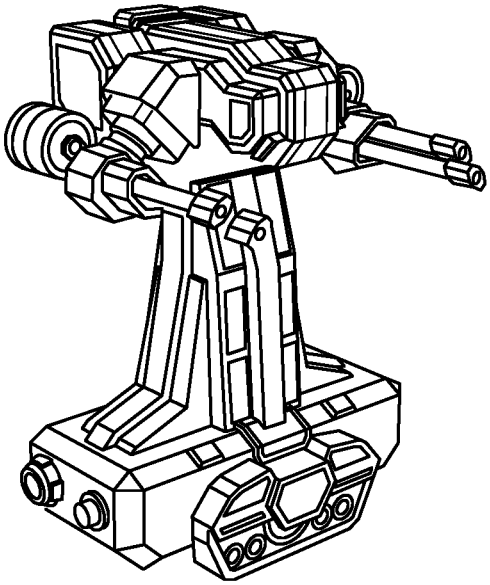
FIG. 14 is an illustration showing an embodiment of a sentry tower that may be utilized by a player during game play of the board game.

In addition to the game board layout, proper game play further requires the selection of a "banker" to organize the gold, ammo tokens, damage tokens, mine tokens, wall sections (see FIG. 15), sentry towers (see FIG. 14) and unused Gladiator cards somewhere out of the way, but within easy reach as game play commences.

In various embodiments, the initial player setup consists of the Betting card, the five "Tiro" sparring Components, ten randomly dealt Non-Weapon Components, ten randomly dealt Weapon Components, the six Gladiator cards for the Gladiators chosen by each of the plurality of players, and a Deus Machina figure.

FIG. 11A is a partially exploded front perspective view of an exemplary embodiment of a game piece 1100A, i.e. a Gladiator and/or a Deus Machina figure that represents and/or is operated by the Gladiator, utilized in the game play of the board game. Additionally, FIG. 11B is a partially exploded front perspective view of another exemplary embodiment of a game piece 1100B utilized in the game play of the board game. As shown, each of the game pieces 1100A, 1100B includes a game piece body 1102, and one or more interchangeable parts 1104 and/or one or more interchangeable accessories 1106 that can be selectively coupled to the game piece body 1102. As noted above, during play of the board game, it may sometimes be necessary or desired for one or more players to interchange one or more parts 1104 or accessories 1106 that are being used with their game piece 1100A, 1100B. Moreover, the need or desire to interchange any parts 1104 and/or accessories 1106 that are being used with the game piece 1100A, 1100B can occur for any suitable reasons that may occur during play of the board game.

In certain embodiments, the interchangeable parts 1104 can include a head/cockpit 1104A, two arms 1104B and a pair of legs 1104C, that are all selectively and magnetically coupled to the game piece body 1102. It should be appreciated that the magnetic coupling between the interchangeable parts 1104 and the game piece body 1102 can be accomplished in any suitable manner. For example, as provided herein, in various embodiments, each of the interchangeable parts 1104 can be selectively coupled to the game piece body 1102 with one or more magnets 1108. More specifically, in some such embodiments, the selective coupling between the interchangeable parts 1104 and the game piece body 1102 can be accomplished by engaging a first magnet 1108A that is secured to the game piece body 1102 with a second magnet 1108B that is secured to the interchangeable part 1104. Alternatively, the selective coupling between the interchangeable parts 1104 and the game piece body 1102 can be accomplished with the use of a single magnet 1108 that is secured to one of the interchangeable part 1104 and the game piece body 1102, in conjunction with a metallic material, e.g., iron, nickel or cobalt, that is attracted by the magnet 1108 and that forms at least a part the other of the interchangeable part 1104 and the game piece body 1102. Still alternatively, the selective coupling between the interchangeable parts 1104 and the game piece body 1102 can be accomplished in another suitable manner, e.g., with one or more adhesive materials.

Additionally, the interchangeable accessories 1106 can include various weapons 1106A, as well as various defense mechanisms 1106B to defend against similar such weapons 1106A. As above, it should be appreciated that the magnetic coupling between the interchangeable accessories 1106 and the game piece body 1102 and/or between the interchangeable accessories 1106 and the interchangeable parts 1104 can be accomplished in any suitable manner. For example, as provided herein, in various embodiments, each of the interchangeable accessories 1106 can be selectively coupled to the game piece body 1102 and/or to the interchangeable parts 1104 with one or more magnets 1108. More specifically, in some such embodiments, the selective coupling between the interchangeable accessories 1106 and the game piece body 1102 can be accomplished by engaging a first magnet 1108A that is secured to the game piece body 1102 with a second magnet 1108B that is secured to the interchangeable accessory 1106; and/or the selective coupling between the interchangeable accessories 1106 and the interchangeable parts 1104 can be accomplished by engaging a first magnet 1108A that is secured to the interchangeable part 1104 with a second magnet 1108B that is secured to the interchangeable accessory 1106. Alternatively, the selective coupling between the interchangeable accessories 1106 and the game piece body 1102 and/or between the interchangeable accessories 1106 and the interchangeable parts 1104 can be accomplished with the use of a single magnet 1108 that is secured to one of the components being selectively coupled together, in conjunction with a metallic material, e.g., iron, nickel or cobalt, that is attracted by the magnet 1108 and that forms at least a part the other component being selectively coupled. Still alternatively, the selective coupling between the interchangeable accessories 1106 and the game piece body 1102 and/or between the interchangeable accessories 1106 and the interchangeable parts 1104 can be accomplished in another suitable manner, e.g., with one or more adhesive materials.

Additionally, due to the interchangeable nature of the parts 1104 and accessories 1106, in various embodiments, the interchangeable parts 1104 and/or the interchangeable accessories 1106 shown with any particular game piece 1100A, 1100B can be selectively (i.e. magnetically) coupled to any of the available game pieces 1100A, 1100B.

Further, although the game pieces 1100A, 1100B illustrated in FIG. 11A and FIG. 11B have a generally humanoid form, it should be understood that the game pieces 1100A, 1100B can have any suitable or desired form. For example, as noted herein above, in addition to the humanoid form, the game pieces 1100A, 1100B can additionally or alternatively be provided in animal form, insect form, arachnid form (e.g., spider-like bots), creature form, robot form, or any other desired form.

Once each player has their initial setup, they are free to layout their Deus Machina on the table in front of them. Each player must also setup their Gladiator with all of his cards forming a small sequential deck (i.e.: 6, then 5, 4, 3, 2, with 1 being on top of the deck), and place it on the table along with their Betting card and Deus Machina. Any unused Components can then be used to form a single Component Pile, which the player may use (and add to) later in the game.

Once the game has been setup and each player has their chosen Gladiator, the players must determine who will be the first Champion for the game. Normally, the player who won the last game of Deus Machina will be selected to be the Champion, as he won the title during the last game. However, if no one has played the game yet, then the owner of the game can be chosen to be the first Champion. Alternatively, the first Champion can be chosen through each of the players rolling one or more dice, with the player with the highest roll (reroll ties) becoming the first Champion. The Champion starts the game with the Champion token.

Finally, the Arena deck must be prepared. Initially, the players can decide how long a game their group wants to play. A game of Deus Machina may typically last about fifteen to twenty minutes for each Arena card added to the Arena deck. However, it should be appreciated that each Arena card can add a greater or lesser amount of time to the total game play than what is specifically noted herein. Once the players have decided how many cards will be in the deck, half the desired number of cards are randomly chosen and shuffled. Next, the "Primus" card in chosen, and the other half of the cards needed (−1 card for the Primus) are randomly chosen and then added to the Primus. This second set of cards is then shuffled. The first pile is then placed on top of the second set of cards without shuffling them again. This forms the completed Arena deck. The players are now ready to play a game of Deus Machina.

The Game Overview:

Each game turn is divided into five basic steps, according to the main activities carried out in that step. More specifically, the five basic steps in each game turn can include, as follows: 1. Tribute Step; 2. Purchase Step; 3. Preparation Step; 4. Combat Step; and 5. Wrap-Up Step.

The Tribute Step:

1. Play for the turn begins by drawing the top card from the Arena Cards deck and placing it the current Arena card position for all players to see.

2. Next, the Champion then deals out a number of Tribute cards to each Gladiator as shown in the top corner of the new Arena card.

3. Then, each Gladiator gains a number of gold coins equal to his Income attribute from the bank.

4. Additionally, Gladiators may attempt to repair any damaged Components in their Junk Pile at a cost of one gold coin per repair attempted. For this step, the Gladiator rolls the number of Repair dice paid for and compares them to his Mechanics attribute. For each successful roll (equal to or higher than the Mechanics, i.e.: 4+, 6+, etc.), the Gladiator may repair one Component of his choice from the Junk Pile, thus returning it to his Component Pile. Any unrepaired Components are discarded to the appropriate discard pile.

The Purchase Step:

1. Bartering is conducted next, with all Gladiators being able to sell or trade any Components with each other, or sell off any Components to the bank for their gold value. However, Tribute cards cannot be traded, sold or passed off to other Gladiators for any reason, although they can be cashed in to the bank for their gold value at any time.

2. Any desired purchases are conducted in order with the Champion going first, then passing the order off to the left or the right. Any Components (Non-Weapons and Weapons) can be purchased for their gold value, but neither of the two Component displays are restocked until a player pays two gold (per display) to restock them. Each of the displays should have four face up Component cards when fully stocked.

Players may either add their new Components directly to their Deus Machina or they may add them to their Component Piles. Either way, there is no limit to the number of Components (Non-Weapon or Weapon) that may be bought during the Purchase Step.

The Preparation Step:

1. For this step, it is necessary to ensure everyone has completed their Deus Machina and is ready for combat. Additionally, it is also necessary to make sure that all players have followed the three basic rules for building their Deus Machina. If any Deus Machina breaks the rules, they must be corrected before the turn continues.

2. Next, the Champion places all required mine tokens, sentry towers and/or wall sections for the current match in the arena as desired. If the match requires all players to be involved in the placement, then they are placed during deployment. It is important to remember that sentry towers and wall sections cannot be used to "trap in" an enemy Deus Machina, there must always be a clear path to walk through.

3. Then, the players determine the Initiative Order. Each player rolls a single D6 and adds it to his Initiative attribute; remembering that the Champion gets a special +3 bonus on the D6 roll. Each player then deploys his Deus Machina in the Initiative Order along with any mine tokens, wall sections or other playing pieces required by the current Arena card. The Deus Machina must be deployed on one of the numbered starting hexes, unless the rules for the current Arena card state otherwise.

4. Any player may place bets on the outcome of the match they are about to fight using the Betting card. However, as noted above, no more than three gold can be placed on any one type of bet, i.e. a win, death or meltdown bet.

The Combat Step:

1. Movement—all Deus Machina move in Initiative Order a number of hexes up to their Speed, changing facing as necessary.

2. Ranged Combat—each Deus Machina fires its ranged weapons in Initiative Order. Add up all weapons at the given range and roll the total Attack dice, making sure to add +1 dice for each weapon making a Back Strike and a −1 for each weapon used in Split Attacks. The Defender then rolls his Defense dice and suffers any damage that gets through.

3. Melee Combat—each Deus Machina attacks in Initiative Order, but a Deus Machina can only attack other figures in base contact with it. Add up all weapons used and roll the total Attack dice, making sure to add +1 dice for each weapon making a Back Strike and a −1 for each weapon used in Split Attacks. The Defender then rolls his Defense dice and suffers any damage that gets through.

4. Resolution—All players remove any Components damaged in the Ranged Combat and/or the Melee Combat steps and place them into their Gladiator's Junk Pile. The players then move any Deus Machina which were displaced during the combat by the Grappling Guns, etc. Finally, the players roll for any Meltdowns, Ejections and Endurance checks, and resolve their effects and possible damage. Finally, the players then remove destroyed Deus Machina.

Combat Steps 1 through 4 are repeated as necessary until the victory conditions of the current Arena card are met. The Combat Rules, as set forth herein below, should be consulted for details.

The Wrap-Up Step:

1. Once the victory conditions of the match the players are playing have been met, the players remove all remaining Deus Machina and other game pieces from the arena and ready the board for the next turn.

2. Any winning bets are then paid out at 2-to-1 odds, and any losing bets are returned to the bank. The bank then pays out the prizes for the match and all Gladiators gain their promotion Ranks. Finally, the new Champion is given the Champion's token before the next turn begins.

The Combat Rules:

Combat in Deus Machina is pretty straight forward. In various embodiments, it is really just a bucket full of dice game, just making sure to follow the following steps during an attack (either Ranged or Melee):

1. First, the attacking Deus Machina chooses a target. During Ranged Combat the target must be in range of any weapons used against it, while in Melee Combat the target must be in base contact with (range 1) the attacking Deus Machina. In either Ranged or Melee Combat, the target cannot be in the blind spot directly behind the Deus Machina, as these are the only hexes which the attacker cannot attack into under normal circumstances.

Figure 12:
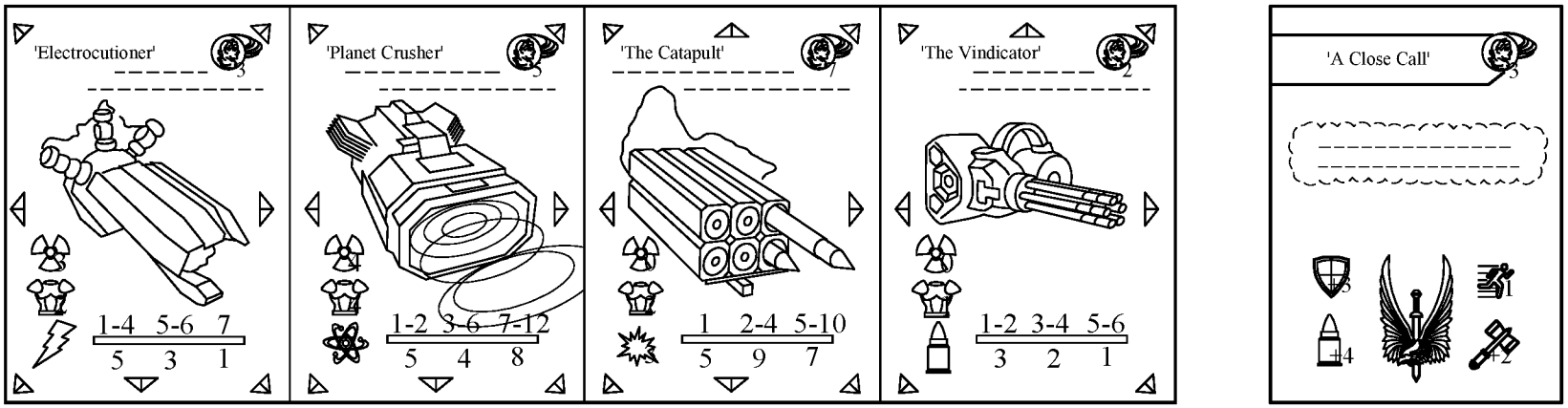
FIG. 12 is an illustration showing an exemplary embodiment of a plurality of Combat Cards and a Tribute Card that a player may hold in their hand during game play of the board game.

2. Next, the attacker must choose which weapons he will use and then add up all the Attack dice for those weapons at that range (or in melee), including any boost dice he opts to add from Tribute cards. For example, FIG. 12 is an illustration showing an exemplary embodiment of a plurality of Combat Cards and a Tribute Card that a player may hold in their hand during game play of the board game. In such example, if the attacker was using these weapons at range 5 and boosting the Vindicator with the Tribute card shown, the total Attack dice would be 19 (3+4+7+1+4). At range 10, the Attack dice would only be 15 (8+7).

3. Next, the attacking Gladiator rolls his Attack dice and compares the numbers rolled to his Gunnery or Fighting attribute as appropriate (for Ranged or Melee Combat) to see how many "hits" are acquired. For each Attack dice rolled that equals or exceeds the Gladiator's relevant attribute (Gunnery or Fighting), one "hit" is scored.

4. The defending Gladiator then adds up all the Defense symbols from his Components. The defender then compares this amount to the number of hits scored by the attacker. The defender's Defense dice are equal to total Defense symbols or to the number of hits the attacker scored, whichever value is less. By way of limitation, a defender cannot have more Defense dice than hits scored.

5. For each of the Defense dice rolled that equals or exceeds the Gladiator's Defense attribute, one hit will be blocked. Thus, the players should subtract the number of successful defense rolls from the amount of hits to find the number of "hits" that must be applied to the target Deus Machina.

6. Now that the total number of hits has been determined, such hits must be applied to the Deus Machina. Hits are applied by the defender, not the attacker. Simply apply the hits as desired, but once a single hit is applied to a given Component, then enough hits to "damage" that Component must be applied to it. In that sense, it is an all or nothing proposition. A damaged Component is then marked with a damage token before any other hits can be applied to other Components. It is important to remember that a Component's Armor symbol shows how many successful hits are required to damage the Component, while understanding that fewer hits will do nothing at all to the Component. Note that if a player can damage a Component, then the player must damage a Component. However, if the player does not have enough hits to damage any Component on the Deus Machina, then the defender ignores any remaining hits from that attack.

7. Finally, damaged Components are only removed during the Resolution Step of the Combat Steps. As such, a "damaged" Component can still function normally and can still be used to attack and defend with until it is finally removed during the Resolution Step. Note that a Gladiator's Special Skills and various Tribute actions can have an effect on these basic combat rules and supersede the basic combat rules whenever the two are in conflict.

Figure 13:
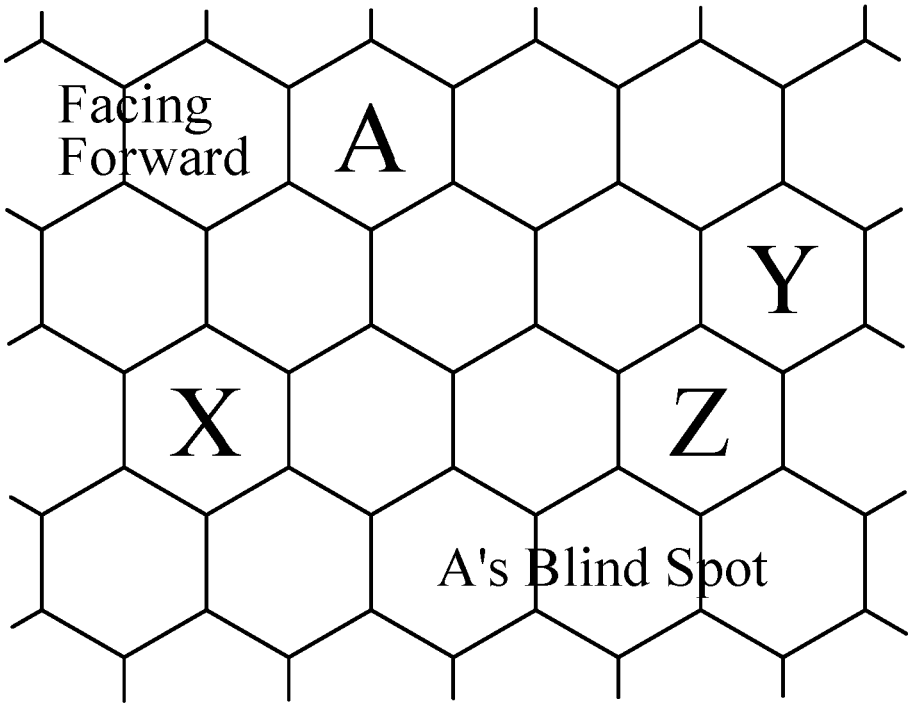
FIG. 13 is an illustration showing a portion of the game board that may be operational at a particular time during game play of the board game.

Special Combat Rules: As set forth herein, there are a few special combat rules to know:

Back Strikes—An attacker gains a special +1 bonus Attack dice for each weapon making a Back Strike. A Back Strike is any attack originating from the line of hexes directly behind a Deus Machina. FIG. 13 is an illustration showing a portion of the game board that may be operational at a particular time during game play of the board game. In the example illustrated in FIG. 13, Deus Machina A is under attack by three attackers. Attacker X is not in position to gain a Back Strike on him, but both Y and Z are in his blind spot and can gain a Back Strike on Deus Machina A. Note that Deus Machina A also cannot fire on Y or Z because they are in his blind spot.

Split Attacks—Normally a Deus Machina only attacks (in either Ranged or Melee Combat) a single target during an attack. However, the attacker may split his attack to strike two targets simultaneously if desired. The split attack is simply carried out as two separate attacks with the attacker choosing which weapons will be used against which targets. A single weapon can only attack one of the two targets. Further, as noted above, a special −1 Attack dice penalty is applied to each of the weapons used in a split attack, regardless of which target it is used against. Split Attacks can be used in both Ranged and Melee Combat.

Mine Tokens—Mines can be placed into the arena by various methods and once placed a mine will detonate when any Deus Machina enters the hex the mine is in or any of the six adjacent hexes. A Deus Machina leaving one of these hexes or moving from the center hex to one of the six adjacent hexes (like when using the Minelaying Unit) will not set off the mine. When a mine is set off the mine does a D6 hits (roll once) to all Components of any Deus Machina in any of the seven affected hexes. However, if the Deus Machina ends its movement (losing any unused Speed) when entering one of a mine's affected hexes, the Gladiator can try to disarm the mine, instead of having it automatically detonate on him. To do so, the Gladiator must roll equal to or higher than his Mechanics attribute on a single D6. If successful, the mine is removed from the arena without detonating. However, if the Gladiator rolls lower than his Mechanics attribute, the mine explodes doing its hits as normal, then it is removed. Like the hits caused by a meltdown, there is no way to reduce the number of hits received by a mine detonation. Such hits are just applied to each Component, and any Components that receive enough hits to equal or exceed their Armor are marked as damaged with a damaged token as normal.

Sentry Towers (see FIG. 14)—These weapon emplacements can be controlled by any Gladiator that manages to get in base contact with them, provided no other Gladiator of an equal or better Mechanics attribute does so too. Each sentry tower has four ranged weapons randomly chosen from the Weapon Components deck assigned to it when it is first deployed, which represents its built-in armaments. Note that none of these weapons can run out of ammunition during the match. The sentry tower weapons can be fired by the Gladiator that is controlling it as a separate attack from the Gladiator's own attacks. These weapons are still fired in the Ranged Combat Step, but using the Gladiator's Mechanics attribute, not his Gunnery. These attacks may be boosted by the controlling Gladiator and can gain the Back Strike bonus when appropriate, but cannot be used to perform Split Attacks. If another Deus Machina moves into a hex adjacent with the sentry tower and that Gladiator has a Mechanics attribute better than that of the controlling Gladiator, the new Gladiator takes control of the sentry tower. If both Gladiators have equal Mechanics attributes, then neither of them can control the sentry tower that round.

Wall Sections (see FIG. 15)—Wall sections provide a simple obstacle for the Deus Machina to maneuver around. With the exception of ranged weapons with the explosive symbol, no attacks can be performed over a wall section. Like sentry towers, walls sections cannot be destroyed by attacking them, although a few Tribute actions can remove them from play. As noted above, wall sections cannot be placed in such a way that other Deus Machina are blocked in or trapped; at least one exit must still be made available.

Surrender—There will be times when it will be tactically sound to surrender instead of letting your Deus Machina be blown to bits, but a player can only surrender at the end of a Resolution Step after all other effects have been resolved. Only then is the Deus Machina removed from the arena. But if a player surrenders, such player automatically loses all bets, even if the player should have otherwise won them. Further, such player gains no Ranks, gains no gold coins as prize money and cannot become the Champion.

Taking Damage—These rules represent the most basic way of taking damage, where the defender simply assigns the hits to a Component of his choosing and Components are removed without affecting the other Components, regardless of power requirements or the layout of the Deus Machina. However, in more advanced rules of an alternative embodiment, it does matter which ones are lost and in what order they are damaged.

Gladiator Death—When a Gladiator dies, that player is not out of the game. Since the Gladiator is the head of his Ludus, when he dies, a new Gladiator takes up the role of leadership and control of the appropriate Deus Machina. To represent this, when the Gladiator dies, the Gladiator cards are returned to the bank and a new Gladiator is picked from the unused Gladiators in the bank before the next turn begins. The new Gladiator starts play at Rank 1, unless he has a Special Skill that says otherwise. Additionally, that player loses all the gold coins he currently has, but he keeps his Components, including those currently in his Junk Pile, which may be repaired later. Such player also keeps any unused Tribute cards in his hand. The new Gladiator begins play as usual at the start of the new turn.

Arena Card Rules:

Most of the Arena cards and the matches they detail need no further clarifications. However, in some non-exclusive alternative embodiments, the Arena Cards can utilize and/or incorporate a few additional rules. Some of these potential additional rules for the Arena Cards are set out in detail herein below. However, it should be appreciated that the reference to any such potential rules is not intended to be limiting in any manner, and the game can be readily played with or without any such additional rules. Still further, the Arena Cards can also be subject to even more additional rules that are not set forth in detail herein without departing from the overall essence of the present invention.

Death Race—Unlike most of the matches, the primary goal of the Death Race is to get around the arena, not to destroy the other Deus Machina. Instead of deploying on the starting hexes, all Deus Machina must be deployed in the hexes adjacent to the arena's center hex. The goal of the match is to be the first one to reach each of the numbered starting hexes. The first Gladiator to do so is the winner. As such, this match tends to favor the underdogs slightly as going first will actually be an advantage. As a special rule, "Curro" the fastest man in the arena, is treated as having an Initiative of zero and the Champion has a −3 Initiative "bonus" instead of a +3 bonus. The hexes can be crossed in any order, so record which ones you have crossed, and multiple starting hexes can be crossed in a single turn if a Deus Machina is fast enough. Once one Gladiator has reached each of the six starting hexes, he wins and the match is over.

Fortress Assault—While the Fortress Assault is a pretty straight forward match, its setup requires a little extra explanation to get right. During the Preparation Step, the Champion must pick who his challenger will be and whether he wants his side to have the sentry towers or the mines and walls. Then the two players may deploy their game pieces (mines and walls first), but be sure not to cover up the starting hexes.

King of the Hill—The Champion deploys anywhere in the arena he desires along with all three sentry towers and his wall section, while all other Deus Machina deploy as normal and form a single team.

The Hot Gates—All the wall sections are used to form a single, twisting, winding wall with weird jutting protrusions, but only a single opening. This wall is setup by the Champion during the Preparation Step, but care must be taken not to cover up the starting hexes.

Tower Defense—The Champion must deploy two sentry towers along the arena's outer row of hexes at opposite sides of the arena. When teams are picked, they must also pick a sentry tower to be "their" sentry tower. The match ends immediately if a member of the enemy team moves (by any means) adjacent to your sentry tower.

The Primus—The Primus is the final match of the game. The winner of the Primus, is the overall Champion and winner of Deus Machina. As such there are a few special rules for running the Primus. It works like a mini-series playoffs. While all the Deus Machina enter the arena together, there are strict rules about who can fight who and when. The Primus is run in a series of one-on-one fights, with one or more battles happening simultaneously. During the Preparation Step, the Champion will pair off each of the Gladiators for the first fight. For example, if a five-player game is being played, the Champion will pair off the other four players for the first preliminaries. Those two battles will be fought simultaneously in the arena, with the Champion sitting it out. Once those fights have ended, either by a Deus Machina being destroyed or by a Gladiator being killed, the Champion must fight one of the winners, while the other Gladiator waits. When that fight has ended, its winner will fight the remaining Gladiator for the Championship. No Gladiator can sit it out for more than one set of fights in a row, and no Gladiator can surrender, as this is for the Championship and the honor of the Gods. The Primus does not end until a winner has been chosen and the game has ended.

It is understood that although a number of different embodiments of the game mechanic and the game pieces 1100A, 1100B have been illustrated and described herein, one or more features of any one embodiment can be combined with one or more features of one or more of the other embodiments, provided that such combination satisfies the intent of the present invention.

While a number of exemplary aspects and embodiments of the game mechanic and the game pieces 1100A, 1100B have been discussed herein above, those of skill in the art will recognize certain modifications, permutations, additions and sub-combinations thereof. It is therefore intended that the game mechanic and the game pieces 1100A, 1100B shall be interpreted to include all such modifications, permutations, additions and sub-combinations as are within their true spirit and scope, and no limitations are intended to the details of construction or design herein shown.

What is claimed is:

1. A game comprising:

a game mechanic including a set of rules by which the game is played;

a game board;

a plurality of game cards; and a game piece in the form of a non-flat, vertically-oriented, three-dimensional figurine that is usable by a player within the game mechanic to engage in at least one combat, the game piece being selectively positioned on and moved to different spaces on the game board in accordance with the set of rules included in the game mechanic, the game piece including (i) a game piece body including a torso, (ii) a plurality of interchangeable parts including at least a plurality of arms and a plurality of pairs of legs that are each selectively and directly magnetically coupled to a particular location on the torso in accordance with the set of rules of the game mechanic, each of the plurality of interchangeable parts being different from one another including each of the plurality of arms having at least one of a different size and a different shape from one another and each of the plurality of pairs of legs having at least one of a different size and a different shape from one another, and (iii) a plurality of interchangeable accessories, each of the plurality of interchangeable accessories being configured to be selectively and directly magnetically coupled to one of the plurality of interchangeable parts, and each of the plurality of interchangeable accessories having a different design and function in accordance with the set of rules of the game mechanic;

wherein at least two of the plurality of interchangeable parts have a different power production from one another and are interchangeable with one another so that they can be alternatively magnetically coupled to a same location on the torso as one of a replacement and an upgrade during play of the game based on at least one of an outcome of the at least one combat and at least one of the plurality of game cards that is obtained by the player in accordance with the set of rules included in the game mechanic; and wherein at least two of the interchangeable accessories are interchangeable with one another so that they can be alternatively magnetically coupled to a same position on one of the plurality of interchangeable parts as one of a replacement and an upgrade during play of the game in accordance with the set of rules included in the game mechanic.

2. The game of claim 1 wherein the game includes a first game piece that is configured for use by a first player and a second game piece that is configured for use by a second player, wherein the game is a battle-based board game that includes at least one combat that is played out between the first game piece of the first player and the second game piece of the second player in accordance with the set of rules included in the game mechanic, wherein a decision to one of replace and upgrade one of the plurality of interchangeable parts is based at least in part on an outcome of the at least one combat, and wherein a decision to one of replace and upgrade one of the plurality of interchangeable accessories is based at least in part on an outcome of the at least one combat.

3. The game of claim 1 further comprising a first magnet that is coupled to the torso, and a second magnet that is coupled to one of the plurality of interchangeable parts.

4. The game of claim 3 wherein the first magnet selectively engages the second magnet so that the one of the plurality of interchangeable parts can be selectively and magnetically coupled to the torso.

5. The game of claim 1 wherein the plurality of interchangeable parts further includes a plurality of heads.

6. The game of claim 1 wherein the plurality of interchangeable accessories includes a plurality of weapons.

7. The game of claim 1 wherein the plurality of interchangeable accessories includes a plurality of defense mechanisms.

8. The game of claim 1 wherein the game piece has a humanoid form; and wherein the game piece is selectively positioned on the game board in an upright manner.

9. The game of claim 1 wherein the at least two of the plurality of interchangeable parts can be alternatively magnetically coupled to the same location on the torso as one of a replacement and an upgrade during play of the game based on at least one of the plurality of game cards that is obtained by the player in accordance with the set of rules included in the game mechanic.

10. A method for providing a game, the method comprising the steps of:

providing a game mechanic including a set of rules by which the game is played;

providing a game board;

providing a plurality of game cards;

preparing a game piece in the form of a non-flat, vertically-oriented, three-dimensional figurine usable by a player within the game mechanic to engage in at least one combat, the game piece including (i) a game piece body including a torso, (ii) a plurality of interchangeable parts including at least a plurality of arms and a plurality of pairs of legs that are each selectively and directly magnetically coupled to a particular location on the torso in accordance with the set of rules of the game mechanic, each of the plurality of interchangeable parts being different from one another including each of the plurality of arms having at least one of a different size and a different shape from one another and each of the plurality of pairs of legs having at least one of a different size and a different shape from one another, and (iii) a plurality of interchangeable accessories, each of the plurality of interchangeable accessories being configured to be selectively and directly magnetically coupled to one of the plurality of interchangeable parts, and each of the plurality of interchangeable accessories having a different design and function in accordance with the set of rules of the game mechanic, at least two of the plurality of interchangeable parts having a different power production from one another and being interchangeable with one another so that they can be alternatively magnetically coupled to a same location on the torso during play of the game in accordance with the set of rules included in the game mechanic, and at least two of the interchangeable accessories being interchangeable with one another so that they can be alternatively magnetically coupled to a same position on one of the plurality of interchangeable parts during play of the game in accordance with the set of rules included in the game mechanic;

selectively interchanging one of the plurality of interchangeable parts that is directly magnetically coupled to a particular location on the torso with another one of the plurality of interchangeable parts that is subsequently directly magnetically coupled to the same particular location on the torso as one of a replacement and an upgrade during play of the game based on at least one of an outcome of the at least one combat and at least one of the plurality of game cards obtained by the player in accordance with the set of rules included in the game mechanic;

selectively interchanging one of the plurality of interchangeable accessories that is directly magnetically coupled to one of the plurality of interchangeable parts with another one of the plurality of interchangeable accessories that is subsequently directly magnetically coupled to the same one of the plurality of interchangeable parts as one of a replacement and an upgrade during play of the game in accordance with the set of rules included in the game mechanic; and selectively positioning the game piece on and moving the game piece to different spaces on the game board in accordance with the set of rules included in the game mechanic.

11. The method of claim 10 wherein the game includes a first game piece that is configured for use by a first player and a second game piece that is configured for use by a second player, wherein the game is a battle-based board game that includes at least one combat that is played out between the first game piece of the first player and the second game piece of the second player in accordance with the set of rules included in the game mechanic, wherein a decision to one of replace and upgrade one of the plurality of interchangeable parts is based at least in part on an outcome of the at least one combat, and wherein a decision to one of replace and upgrade one of the plurality of interchangeable accessories is based at least in part on an outcome of the at least one combat.

12. The method of claim 10 further comprising the steps of coupling a first magnet to the torso, and coupling a second magnet to one of the plurality of interchangeable parts.

13. The method of claim 12 further comprising the step of engaging the first magnet with the second magnet so that the one of the plurality of interchangeable parts can be selectively and magnetically coupled to the torso.

14. The method of claim 10 wherein the step of preparing includes the plurality of interchangeable parts further including a plurality of heads.

15. The method of claim 10 wherein the step of preparing includes the plurality of interchangeable accessories including a plurality of weapons.

16. The method of claim 10 wherein the step of preparing includes the plurality of interchangeable accessories including a plurality of defense mechanisms.

17. The method of claim 10 wherein the step of preparing includes the game piece having a humanoid form; and wherein the step of selectively positioning includes the game piece being positioned in an upright manner on the game board.

18. The method of claim 10 wherein the step of selectively interchanging one of the plurality of interchangeable parts includes selectively interchanging one of the plurality of interchangeable parts that is directly magnetically coupled to a particular location on the torso with another one of the plurality of interchangeable parts that is subsequently directly magnetically coupled to the same particular location on the torso as one of a replacement and an upgrade during play of the game based on at least one of the plurality of game cards obtained by the player in accordance with the set of rules included in the game mechanic.

* * * * *